US005133274A

United States Patent [19]

Grant

[11] Patent Number: 5,133,274

[45] Date of Patent: Jul. 28, 1992

[54] KINETIC INTEGRAL STEERING SYSTEM

[76] Inventor: Kenneth J. Grant, 2101 Nuuanu Ave., No. 1806, Honolulu, Hi. 96817

[21] Appl. No.: 654,532

[22] Filed: Feb. 13, 1991

[51] Int. Cl.[5] ..... B63H 25/52

[52] U.S. Cl. ..... 114/172

[58] Field of Search ..... 114/144 R, 162, 172; 440/55

[56] References Cited

U.S. PATENT DOCUMENTS 3,279,410 10/1966 Young ..... 114/172

3,382,837 5/1968 Aumack ..... 440/55

*Primary Examiner*—Sherman Basinger

*Attorney, Agent, or Firm*—Michael I. Kroll

[57] ABSTRACT

A kinetic integral steering system is provided for a sailboat of the type having a hull, a cockpit with a pair of side cockpit seats located at the stern, a cabin, a mast, a boom, a rudder with post and a pivotable tiller to control the rudder. The system consists of a pair of crossbars, a mechanism for securing the crossbars between the cockpit seats in a horizontal parallel relationship and a wheel concentrically pivoted between the center of the crossbars. The wheel has a cutout area to receive the tiller to normally keep the tiller in a straight stationary position to allow the sailboat to travel in a straight line through the water. The tiller can be adjustably positioned thereto to compensate for wind and course corrections.

7 Claims, 2 Drawing Sheets

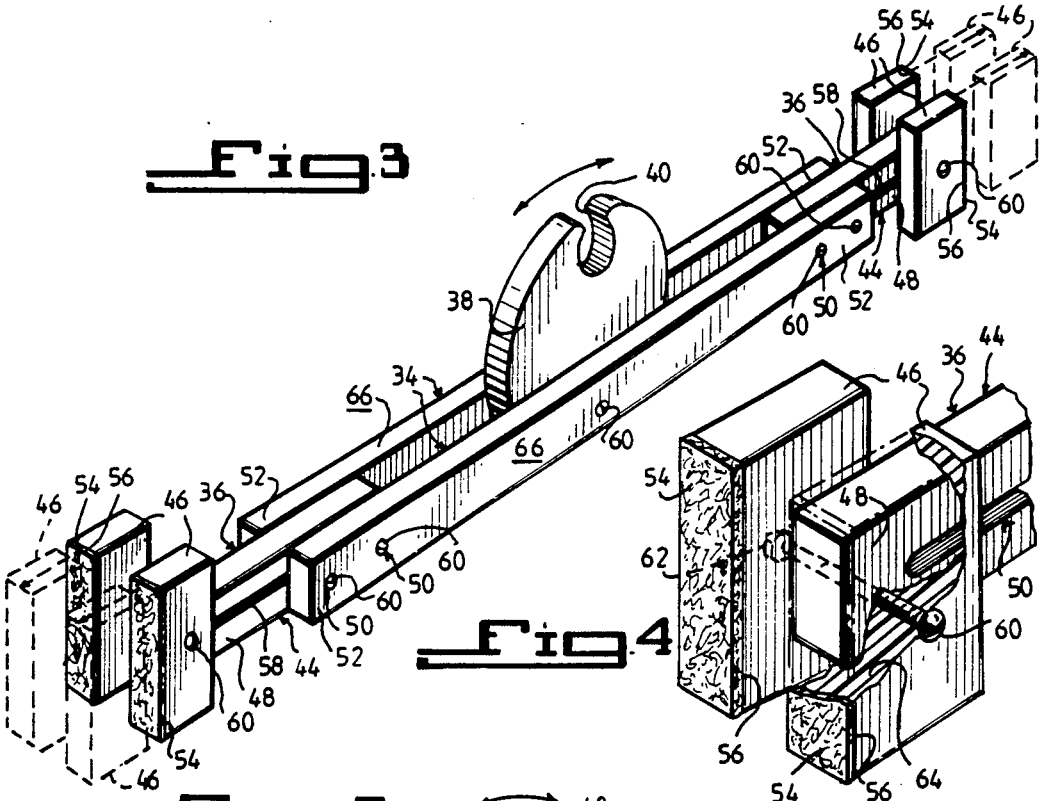
Fig.3
Fig.4
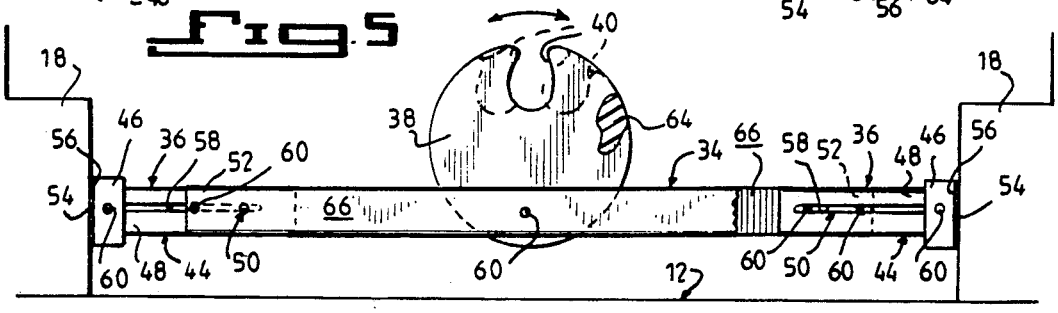
Fig.5
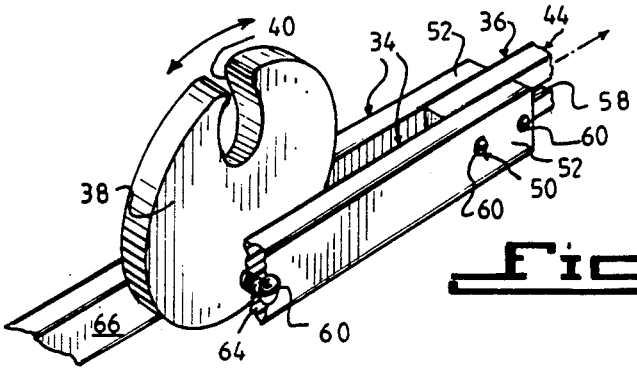
Fig6

KINETIC INTEGRAL STEERING SYSTEM

BACKGROUND OF THE INVENTION

1.Field of the Invention

The instant invention relates generally to steering mechanisms in boats and more specifically it relates to a kinetic integral steering system.

2.Description of the Prior Art

Numerous steering mechanisms in boats have been provided in prior art that are adapted to be tillers which are levers used to turn rudders and steer boats in the water. While these units may be suitable for the particular purpose to which they address, they would not be as suitable for the purposes of the present invention as heretofore described.

SUMMARY OF THE INVENTION

A primary object of the present invention is to provide a kinetic integral steering system that will overcome the shortcomings of the prior art devices.

Another object is to provide a kinetic integral steering system that is instant between the cockpit seats so as to engage the tiller and maintain it in a straight stationary position, so as to allow a sail boat to travel in a straight line through the water.

An additional object is to provide kinetic integral steering system in which the tiller can be adjustably positioned thereto to compensate for wind and course corrections.

A further object is to provide a kinetic integral steering system that is simple and easy to use.

A still further object is to provide a kinetic integral steering system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 3 is perspective view of the instant invention showing in dotted, the adjustable feature thereof.

FIG. 4 is an enlarged perspective view with parts broken away showing how two of the bearing members are attached to one of the adjustment arms.

FIG. 5 is a front view taken in direction of arrow 5 in FIG. 3 with parts broken away showing installation between two cockpit seats in the boat.

FIG. 6 is a perspective view of a portion of the invention showing how the wheel is attached to the crossbars.

DETAILED DESCRIPTION OF THE PREFERRED EMBODIMENTS

Figure 1:
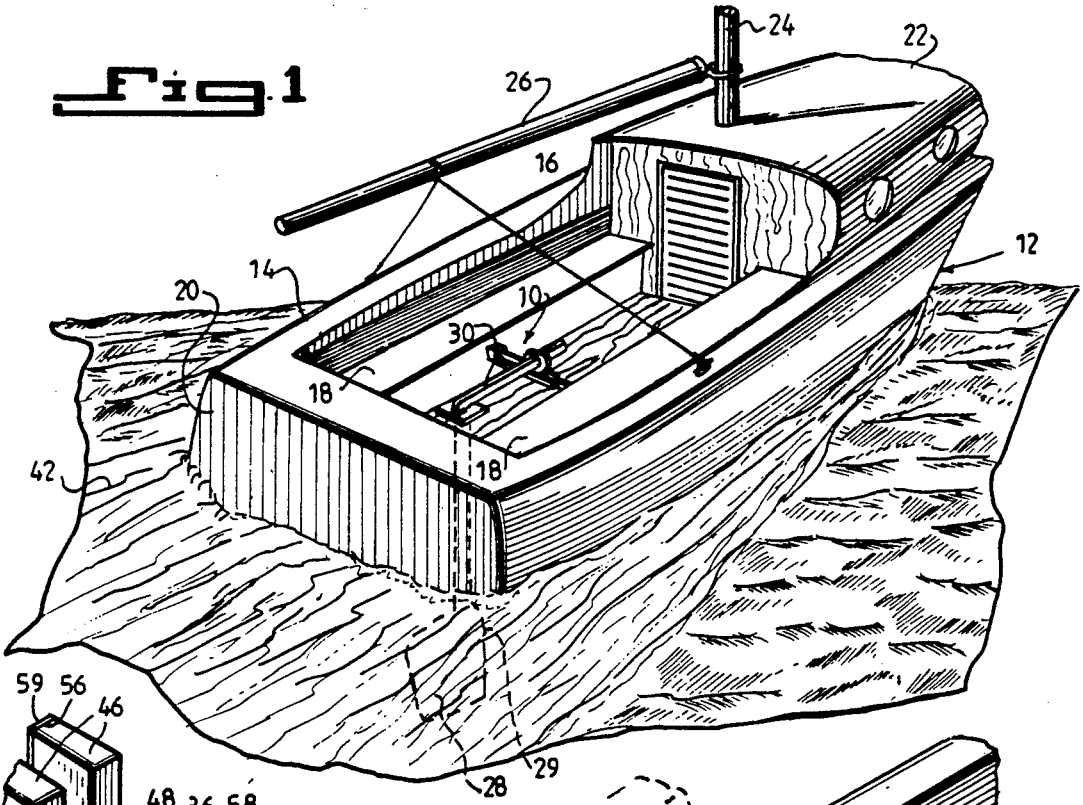
FIG. 1 is a perspective view of a boat with the instant invention installed therein and in use.
Figure 2:
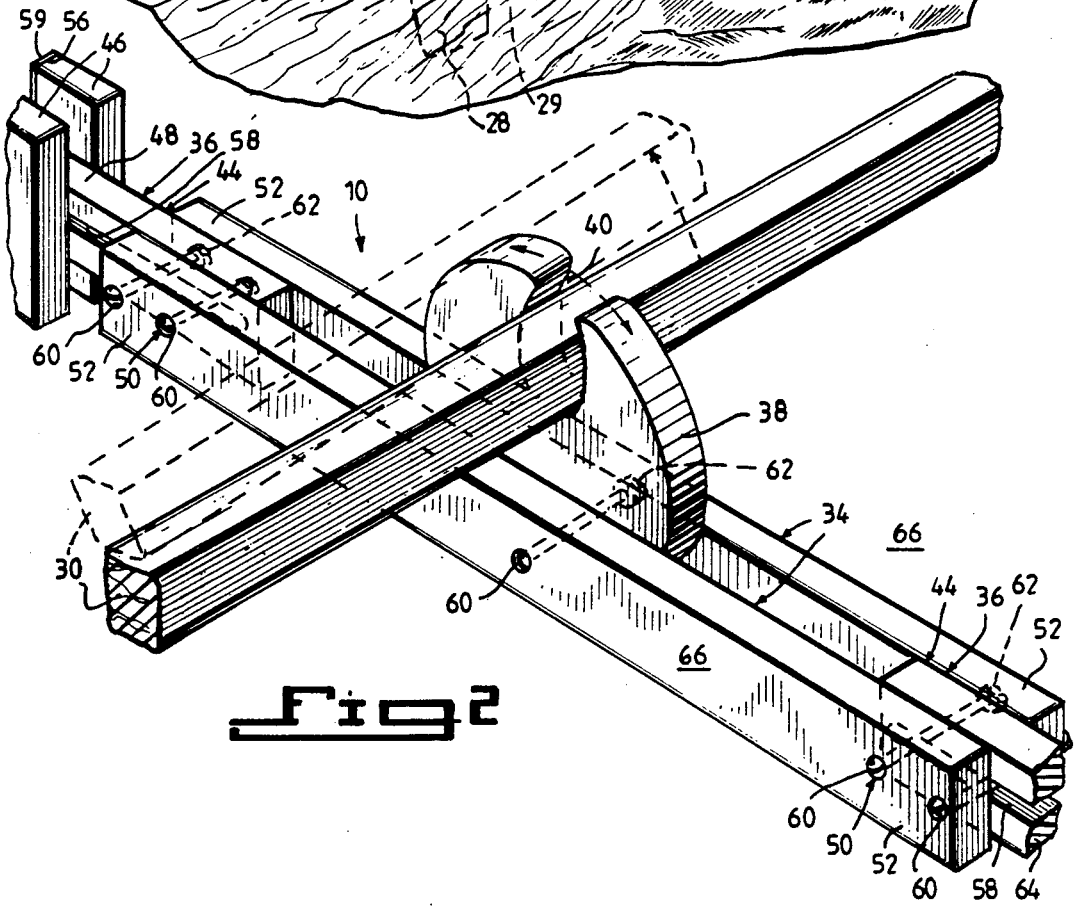
FIG. 2 is a perspective view with parts broken away of the instant invention showing how the tiller engages the wheel.

Turning now descriptively to the drawings, in which similar reference characters denote similar elements throughout the several views, the Figures illustrate a kinetic integral steering system 10, for a sailboat 12 of the type having a hull 14, a cockpit 16 with a pair of side cockpit seats 18 located at the stern 20, a cabin 22, a mast 24, a boom 26, a rudder 28 with post 29 and a pivotable tiller 30 to control the rudder 28. The system 10 consists of a pair of crossbars 34, a mechanism 36 for securing the crossbars between the cockpit seats 18 in a horizontal parallel relationship and a wheel 38 eccentrically pivoted between the center of the crossbars 34. The wheel 38 has a cutout area 40 to receive the tiller 30 to normally keep the tiller 30 in a straight stationary position to allow the sailboat 12 to travel in a straight line through the water 42. The tiller 30 can be adjustably positioned thereto to compensate for wind and course corrections.

The securing mechanism 36 includes a pair of arms 44, two pair of bearing members 46 with each said pair of bearing members 46 connected to a distal end 48 of one arm 44 and a mechanism 50 for adjustably connecting each arm 44 between one end 52 of the crossbar 34 so that the respective pair of bearing members 46 will press against one of the cockpit seats 18 in the cockpit 16 of the sailboat 12. Each bearing member 46 includes a pad 54 secured to one outward side 56 thereof which will prevent slippage against the cockpit seat 18.

Each adjusting mechanism 50 includes the arm 44 having a elongated horizontal slot 58. A pair of machine screws 60 are spaced apart and extending through one end 52 of the crossbars 34 and the elongated horizontal slot 58 in the arm 44. A pair of nuts 62 are provided, with each threadable onto one end of one of the machine screws 60 so as to hold the arm 44 in an adjusted position thereto.

The wheel 38 is concentrically pivoted between the center of the crossbars by a machine screw 60 and a nut 62, wherein each pair of bearing members 46 are connected to a distal end 48 of one arm 44 by a machine screw 60 and a nut 62.

The crossbars 34, the wheel 38, the arms 44 and the bearing members 46 are all fabricated out of a heavy durable plastic material. Each crossbar 34 is in a rectangular shaped flat board configuration 66 so that when the crossbars 34 are placed in a horizontal parallel relationship, each arm 44 can slideably fit between the ends 52 of the crossbars 34.

Installation Of The Kinetic Integral Steering System 10

1. Loosen the machine screws 60 so that arms 44 will slide in and out.
2. Position the bearing members 46 against the cockpit seats 18 one quarter to one third of the way back from the free end of the tiller 30.
3. Slide the arms 44 equally so that the bearing members 46 are tight against the cockpit seats 18 one quarter of the way down from the top.
4. Tighten the machine screws 60 firmly.
5. Place hands over the pads 54 and push down equally until it is one third to one quarter away from the bottom of the cockpit 16.
6. The system 10 is now ready to operate. It may be removed or installed in seconds without further adjustments.

Operation Of The Kinetic Integral Steering System 10

1. Manually steer the sailboat 12 to a desired course or point of sail.

2. Trim the sails.
3. Place the tiller 30 in the cutout area 40 in the wheel 38 in its center position.
4. Move the tiller 30 in either direction until the sailboat is on the desired course, or point of sail.
5. The system 10 will now guide the sailboat 12 whereby adjustments may be made at any time.
6. To steer manually, or maneuver, lift the tiller 30 out of the cutout area 40 in the wheel 38.
7. When you wish to return to the operation of the system 10, repeat steps 2 and 3 or 3 and 2 as desired.
8. To increase the range of the system 10 move it aft and to decrease the range move it forward.

When sailing on the sailboat 12 people should wear, or trail, a safety line whenever they go on deck. Should they fall overboard, the sailboat 12 will sail away from them. Man-overboard drills are highly recommended before sailing on a sailboat 12 that is utilizing the kinetic integral steering system 10.

LIST OF REFERENCE NUMBERS kinetic integral steering system
sailboat
hull
cockpit
side cockpit seat
stern
cabin
mast
boom
rudder
post
tiller
pivotable tiller
crossbar
securing mechanism
wheel
cutout area in 38
water
arm
bearing member
distal end of 44
adjusting mechanism
end of 34
pad
outward side of 46
elongated horizontal slot in 44
machine screw
nut
heavy durable plastic material
rectangular shaped flat board configuration for 34

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A kinetic integral steering system for a sailboat of the type having a hull, a cockpit with a pair of side cockpit seats located at the stern, a cabin, a mast, a boom, a rudder with post and a pivotable tiller to control the rudder, said system comprising:

a) a pair of crossbars;

b) means for securing said crossbars between the cockpit seats in a horizontal parallel relationship;

c) said securing means includes a respective pair of arms each having respective distal ends, said securing means further includes two pair of bearing members sandwiching a respective one of said distal ends of one of said respective arms, said securing means still further includes means for adjustably connecting each said arm between one end of said crossbars so that said respective pair of bearing members will press against one of said cockpit seats in the cockpit of the sailboat; and d) a wheel eccentrically pivoted between the center of said crossbars, said wheel having a cutout area to receive the tiller to normally keep the tiller in a straight stationary position to allow the sailboat to travel in a straight line through the water, while the tiller can be adjustably positioned thereto to compensate for wind and course corrections.

2. A kinetic integral steering system as recited in claim 1, wherein each said bearing member includes a pad secured to one outward side thereof which will prevent slippage against the cockpit seat.

3. A kinetic integral steering system as recited in claim 2, wherein each said adjusting means includes:

a) each said arm having an elongated horizontal slot;

b) a pair of machine screws spaced apart and extending through one end of said crossbars and the elongated horizontal slot in each said arm; and c) a pair of nuts, each threadable onto one end of one of said machine screws so as to hold each said arm in an adjusted position thereto.

4. A kinetic integral steering system as recited in claim 3, wherein said wheel is eccentrically pivoted between the center of said crossbars by a machine screw and a nut.

5. A kinetic integral steering system as recited in claim 4, wherein each said pair of bearing members sandwiches a respective one of said distal ends of a respective one of said respective arms by a machine screw and a nut.

6. A kinetic integral steering system as recited in claim 5, wherein said crossbars, said wheel, said arms and said bearing members are all fabricated out of a heavy durable plastic material.

7. A kinetic integral steering system as recited in claim 6, wherein each said crossbar is in a rectangular shaped flat board configuration. so that when said crossbars are placed in a horizontal parallel relationship each said arm can slideably fit between the ends of said crossbars.

* * * * *